US007985106B2

(12) United States Patent
Sugiyama et al.

(10) Patent No.: US 7,985,106 B2
(45) Date of Patent: Jul. 26, 2011

(54) FEMALE TYPE TERMINAL PIN

(75) Inventors: Norio Sugiyama, Shizuoka (JP); Toshinori Yamamoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/458,478

(22) Filed: Jul. 14, 2009

(65) Prior Publication Data

US 2010/0015863 A1 Jan. 21, 2010

(30) Foreign Application Priority Data

Jul. 17, 2008 (JP) ..... 2008-185899

(51) Int. Cl.
*H01R 11/22* (2006.01)

(52) U.S. Cl. ..... 439/852

(58) Field of Classification Search ..... 439/851, 439/852, 849, 850, 854, 862
See application file for complete search history.

(56) References Cited

U.S. PATENT DOCUMENTS

| | | | | |
|---|---|---|---|---|
| 5,788,542 | A | 8/1998 | Miwa | |
| 5,941,740 | A * | 8/1999 | Neuer et al. | 439/852 |
| 5,951,339 | A * | 9/1999 | Chaillot et al. | 439/852 |
| 6,174,208 | B1 * | 1/2001 | Chen | 439/852 |
| 6,264,509 | B1 * | 7/2001 | Kwang et al. | 439/852 |
| 6,293,832 | B1 * | 9/2001 | Yamamoto | 439/850 |
| 2003/0216085 | A1 | 11/2003 | Maeda | |

FOREIGN PATENT DOCUMENTS

| | | | |
|---|---|---|---|
| JP | 08-306420 | A | 11/1996 |
| JP | 08-321343 | A | 12/1996 |
| JP | 2000-036350 | A | 2/2000 |
| JP | 2003-331964 | A | 11/2003 |

* cited by examiner

*Primary Examiner* — Neil Abrams
*Assistant Examiner* — Phuongchi T Nguyen
(74) *Attorney, Agent, or Firm* — Edwards Angell Palmer & Dodge LLP

(57) ABSTRACT

An electric contact part 10 of a female type terminal pin 1A includes: a tube member 11; and a projection 21A. A tab 51 of a male type terminal pin 5 is inserted into the tube member 11 via an opening at one end 11*a* of the tube member 11. The projection 21A is extended to the tube member 11, and projected toward an inside of the tube member 11 so as to partially cover the opening at the one end 11*a* of the tube member 11. The projection 21A includes: an extending piece 23; and an abutting piece 24. The extending piece 23 is extended to an upper wall 16*a* of the tube member 11 and extended toward the inside of the tube member 11. The abutting piece 24 is extended from the extending piece 23 toward the upper wall 16*a* to prevent the extending piece 23 from approaching the upper wall 16*a*.

4 Claims, 7 Drawing Sheets

FEMALE TYPE TERMINAL PIN

CROSS REFERENCE TO RELATED APPLICATIONS

This application is on the basis of Japanese Patent Application No. 2008-185899, the contents of which are hereby incorporated by reference.

BACKGROUND OF THE INVENTION

1. Field of the Invention

The present invention relates to a female type terminal pin having an electric contact to which a male type terminal pin is connected.

2. Description of the Related Art

Many electric devices are mounted on a vehicle, and the electric devices are electrically connected to the vehicle or the other electric devices via wiring harnesses. The wiring harness and the electric device are electrically connected to each other when a connector of the wiring harness and a connector of the electric device are connected to each other. The wiring harness transmits the electric power, control signals, and the like.

In such a pair of connectors, one connector includes a male type terminal pin, and a connector housing receiving the male type terminal pin. The male type terminal pin is made by such as folding a conductive metal plate. The male type terminal pin includes a wire connecting part for connecting to an electric wire of the wiring harness and a tab-shaped electric contact part.

The mating connector includes a female type terminal pin and a connector housing receiving the female type connector housing. The female type terminal pin is made by such as folding a conductive metal plate. The female type terminal pin includes a wire connecting part for connecting to an electric wire of the wiring harness and an electric contact part for connecting to the electric contact part of the male type terminal pin.

The electric contact part of the female type terminal pin integrally includes a tube member and an elastic piece. The tube member is formed in a tubular shape, and the electric contact of the male type terminal pin is inserted into an opening at one end of the tube member. The elastic piece is disposed in the tube member and pushes the electric contact part of the male type terminal pin toward an inner wall of the tube member to catch and hold the electric contact part between the elastic piece and the inner wall of the tube member.

In the electric contact part of the female type terminal pin, when the connectors are connected to each other, the electric contact part of the male type terminal pin is inserted into the tube member, and held in the tube member by the elastic piece. Then, both of the electric contact parts are electrically connected to each other, and the male and female type terminal pins are electrically connected to each other.

However, a foreign object larger than the electric contact of the male type terminal pin (for example, a jig for removing the terminal pin from the connector housing) may accidentally be inserted into the tube member. Then, when the foreign object is inserted into the tube, the elastic piece is excessively deformed to be permanently deformed or damaged. Alternatively, a contact surface of the elastic piece or the inner wall of the tube member is damaged to increase contact resistance of the contact surface. Thus, reliability of electric contact between the male and female terminal pins may be reduced.

For solving such a problem, for example, the electric contact part of the female type terminal pin has a projection (for example, see Patent Documents 1 to 4). The projection is formed by forming a long outer wall at the one end of the tube member, and then folding once the outer wall toward an inside of the tube member. The projection is projected toward the inside of the tube member to partially cover the opening at the one side of the tube member.

Thus, by partially covering the opening of the tube member with the projection, the foreign object is prevented from accidentally being inserted into the tube member. Further, by folding the projection obliquely such that as the projection extends toward the other end (rear side) of the tube member, the projection gradually approaches a center axis of the tube member, the electric contact part of the male type terminal pin can be smoothly guided into the tube member (for example, see Patent Document 4).

[Patent Document 1] Japanese Published Patent Application No. 2003-331964

[Patent Document 2] Japanese Published Patent Application No. H08-321343

[Patent Document 3] Japanese Published Patent Application No. H08-306420

[Patent Document 4] Japanese Published Patent Application No. 2000-36350

However, the projection described in Patent Documents 1 to 4 is formed by folding only once the outer wall at the one side of the tube member toward the inside of the tube member. Therefore, when the foreign object larger than the electric contact of the male type terminal pin is forcibly pushed into the tube member, the projection is deformed toward the inside of the tube member, and the foreign object may be inserted into the tube member.

Then, as described the above, the elastic piece may be excessively deformed to be permanently deformed or damaged. Further, the contact surface of the elastic piece or the inner wall of the tube member may be damaged to increase contact resistance of the contact surface. Thus, reliability of electric contact between the male and female terminal pins may be reduced.

Accordingly, an object of the present invention is to provide a female type terminal pin to surely prevent a foreign object from being inserted into a tube member, to prevent an electric contact part from being deformed, and to improve electric contact reliability.

SUMMARY OF THE INVENTION

In order to attain the object, according to the present invention, there is provided a female type terminal pin including:

an electric contact part for connecting to a male type terminal pin, wherein the electric contact part includes: a tube member into which an electric contact part of the male type terminal pin is inserted from an opening at one end side of the tube member; and a projection extended to the tube member and projected toward an inside of the tube member so as to partially cover the opening at the one end side, and wherein the projection includes: an extending piece extended to an outer wall of the tube member, and extended toward the inside of the tube member; and an abutting piece extended from the extending piece toward the outer wall, and preventing the extending piece from approaching the outer wall.

According to another aspect of the invention, there is provided a female type terminal pin including:

an electric contact part for connecting to a male type terminal pin, wherein the electric contact part includes: a tube member into which an electric contact part of the male type terminal pin is inserted from an opening at one end side; and a projection extended to the tube member and projected toward an inside of the tube member so as to partially cover the opening at the one end side, wherein the projection includes: an extending piece extended to one outer wall of the tube member, and extended toward the inside of the tube member; and locking pieces projected from both ends of the extending piece in a width direction thereof, and wherein the tube member includes: locking holes through which the locking pieces are passed, and locking the locking pieces in a direction that the extending piece approaches the one outer wall.

Preferably, the electric contact further includes: another projection projected toward the projection from an inner wall of the tube member facing the projection, and a gap between a top of the projection and a top of the another projection is a little larger than a thickness of the electric contact part of the male type terminal pin.

These and other objects, features, and advantages of the present invention will become more apparent upon reading of the following detailed description along with the accompanied drawings.

DETAILED DESCRIPTION OF THE PREFERRED EMBODIMENTS

First Embodiment

Figure 1:
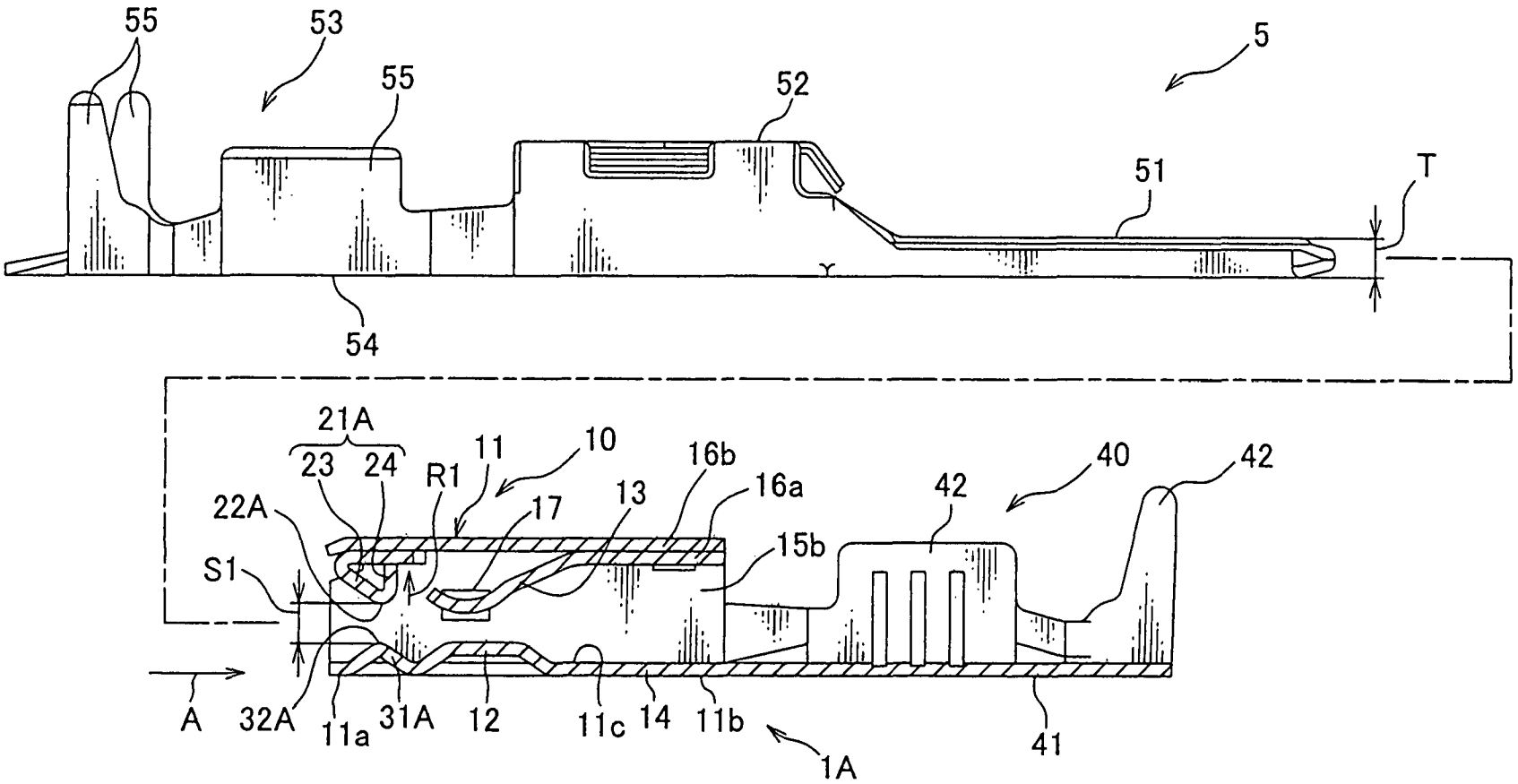
FIG. 1 is a partially sectional view showing male and female terminal pins according to a first embodiment of the present invention.

Hereafter, a female type terminal pin 1A according to a first embodiment of the present invention will be explained with reference to FIGS. 1 to 3. The female type terminal pin 1A is received in a connector housing of a not-shown connector, and when the connector is connected to a mating connector, the female type terminal pin 1A is electrically connected to a male type terminal pin 5 received in a connector housing of the mating connector.

The male type terminal pin 5 is made by pressing a metal plate. As shown in FIG. 1, the male type terminal pin 5 integrally includes: a tab 51 as an electric contact part; a tube member 52; and a wire connecting part 53. In the male type terminal pin 5, the tab 51, the tube member 52, and the wire connecting part 53 are sequentially arranged in a line.

The tab 51 is extended to the tube member 52, and formed in an oblong plate shape. A tip of tab 51 is tapered. The tube member 52 is extended to both the tab 51 and the wire connecting part 53, and formed in a box shape. The tube member 52 is received in a terminal receiving chamber of the connector housing, and closely contacts an inner wall of the terminal receiving chamber.

The wire connecting part 53 is extended to the tube member 52. The wire connecting part 53 includes: a bottom plate 54 extended to the tube member 52; and a plurality of crimping pieces extended to the bottom plate 54. The bottom plate 54 is formed in an oblong plate shape. An end of an electric wire at which core wire is exposed is disposed on the bottom plate 54.

The crimping pieces 55 are disposed at both ends of the bottom plate 54 in a width direction of the bottom plate 54. Each crimping piece 55 is bent toward the bottom plate 54, and crimped to catch the electric wire between the crimping piece 55 and the bottom plate 54. By catching the electric wire with the crimping piece 55, the electric wire is attached to the wire connecting part 53, and the male type terminal pin 5 is electrically connected to the electric wire.

The female type terminal pin 1A is made by pressing a metal plate. As shown in FIG. 1, the female type terminal pin 1A integrally includes: an electric contact part 10; and a wire connecting part 40. The electric contact part 10 integrally includes: a tube member 11, a contact part 12, an elastic piece 13, a projection 21A, and an embossing part 31A as a second projection.

Figure 2:
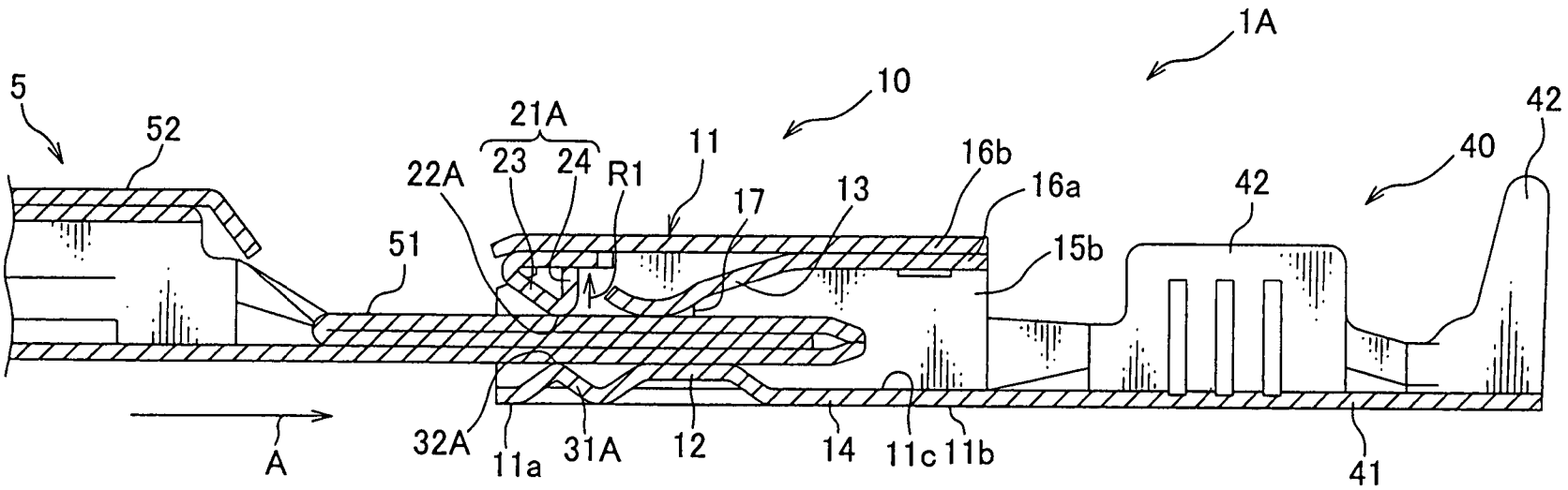
FIG. 2 is a sectional view showing a state that the male type terminal pin is connected to the female type terminal pin shown in FIG. 1.

As shown in FIG. 2, the tube member 11 includes: a bottom wall 14 arranged substantially the same plane as a later-described bottom plate 41 of the wire connecting part 40; a pair of side walls 15*a*, 15*b* extended to the bottom wall 14 (in FIG. 2, only the side wall 15*b* is shown); and a pair of top walls respectively extended to the side walls 15*a*, 15*b* and overlapped with each other. The tube member 11 is formed in a box shape. The tab 51 is inserted along an arrow A into an opening at an end 11*a* away from the wire connecting part 40 of the tube member 11. The arrow A indicates an insertion direction A of the male type terminal pin 5.

The bottom wall 14, the pair of side walls 15*a*, 15*b*, the pair of top walls 16*a*, 16*b* are formed in an oblong plate shape. The top wall 16*a* is extended to the side wall 15*a*, and disposed at an inside of the tube member 11. The top wall 16*b* is extended to the side wall 15*b*, and disposed at an outside of the tube member 11. Incidentally, the top wall 16*a* corresponds to "the outer wall" in claims.

The contact part 12 is formed by partially embossing the bottom wall 14 of the tube member 11, and projected toward an inside of the tube member 11. The contact part 12 is disposed at substantially the center of the tube member 11. The tab 51 inserted into the tube member 11 is overlapped with the contact part 12.

The elastic piece 13 is formed in an oblong plate shape. The elastic piece 13 is extended to the upper wall 16*a* at the other end side 11*b* of the tube member 11, and extended from the upper wall 16*a* toward an inside of the tube member 11 and toward the one end 11*a*. The elastic piece 13 is elastically deformable toward the upper wall 16*a*. A tip of the elastic piece 13 and the contact part 12 face each other in a direction perpendicular to the terminal pin insertion direction A. The elastic piece 13 presses the tab 51 inserted into the tube member 11 toward the contact part 12, and holds the tab 51 with the contact part 12.

Projecting pieces (not shown) are formed at a tip of the elastic piece 13. The projecting pieces are projected from both ends of the elastic piece 13 in a width direction. The projection pieces are respectively inserted into through holes 17 formed at both side walls 15*a*, 15*b*. Because the projecting pieces are inserted into the through holes 17, the elastic piece 13 is not excessively deformed, and prevented from being permanently deformed or damaged.

The projection 21A is disposed near the one end 11*a* of the tube member 11. The projection 21A is extended to the tube member 11, and projected toward an inside of the tube member 11 to partially cover the opening at the one end 11*a* of the tube member 11. The projection 21A is formed by making the upper wall 16*a* longer than the upper wall 16*b*, the side walls 15*a*, 15*b*, and then folding the longer upper wall 16*a* toward an inside of the tube member 11. The projection 21A includes an extending piece 23 and an abutting piece 24. A section of the projection 21A along the terminal pin insertion direction A is substantially a V shape.

The extending piece 23 is formed in a rectangular flat plate shape. The extending piece 23 is extended to an end of the upper wall 16*a* at the one end 11*a* of the tube member 11, and extended from the end toward the inside of the tube member 11 and toward the other end 11*b* (rear side). Further, the extending piece 23 is extended obliquely and approaches the center axis of the tube member 11 as the extending piece 23 is extended toward the other end 11*b* of the tube member 11. The extending piece 23 works as a guiding wall for inserting the tab 51 into the tube member 11.

The abutting piece 24 is formed in a rectangular flat plate shape. The abutting piece 24 is extended to an end of the extending piece 23 away from the upper wall 16*a*, and extended from the end toward the upper wall 16*a* in a direction perpendicular to the upper wall 16*a*. A tip of the abutting piece 24 is extended to about to contact the upper wall 16*a*. The tip of the abutting piece 24 can abut on the upper wall 16*a* in the direction perpendicular to the upper wall 16*a*. Incidentally, the direction perpendicular to the upper wall 16*a* is a direction R1 that the extending piece 23 approaches the upper wall 16*a*.

Figure 3:
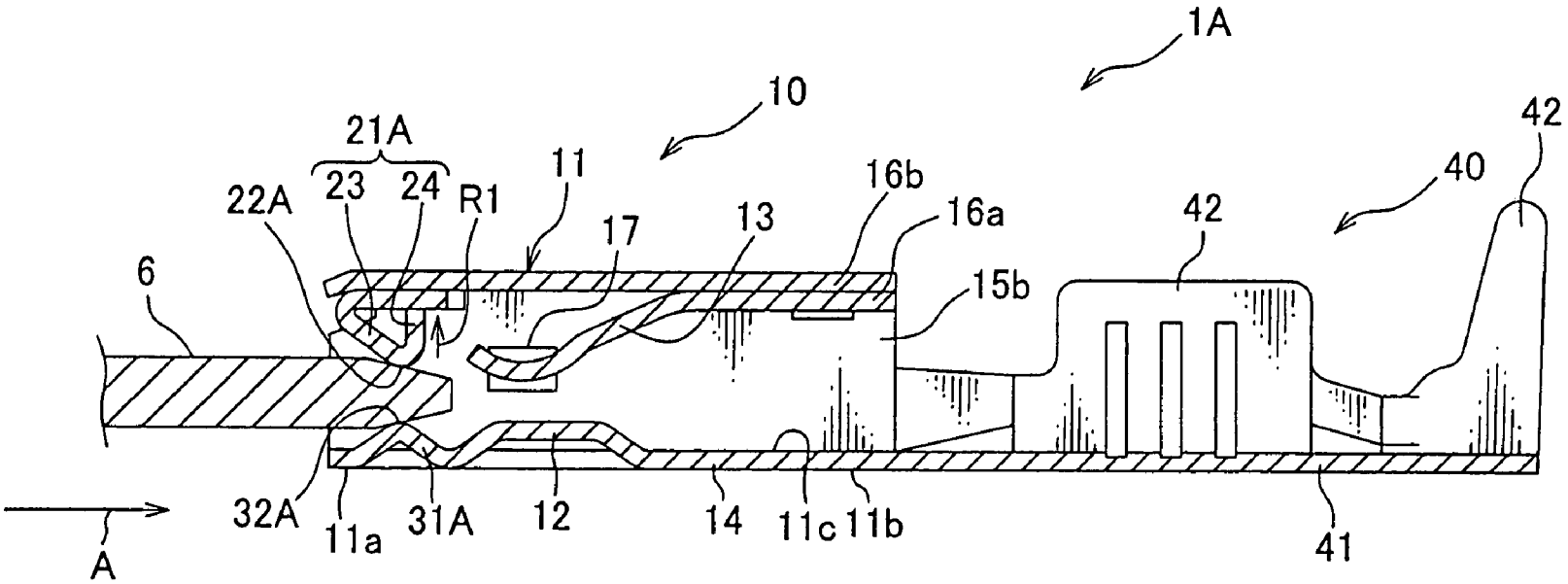
FIG. 3 is a sectional view showing a state that a jig is pushed into the female type terminal pin shown in FIG. 1.

As shown in FIG. 3, when a jig 6 larger (thicker) than the tab 51 is forcibly pushed into the tube member 11, and large force acts on the extending piece 23, the tip of the abutting piece 24 abuts on the upper wall 16*a* to prevent the extending piece 23 from approaching the upper wall 16*a*, and to prevent the extending piece 23 from being deformed. Incidentally, the jig 6 is used when the female type terminal pin 1A is removed from the connector housing.

The embossing part 31A is formed near the one end 11*a* of the tube member 11. The embossing part 31A is extended to the tube member 11, and embossed toward the inside of the tube member 11 to partially cover the opening at the one end 11*a* of the tube member 11. The embossing part 31A is formed by partially embossing the bottom wall 14 of the tube member 11, and embossed from an inner wall 11*c* of the tube member 11 toward the projection 21A. A sectional shape of the embossing part 31A along the terminal pin insertion direction A is formed in an inverted V shape. The embossing part 31A and the projection 21A face each other in a direction perpendicular to the terminal pin insertion direction A.

A top 22A of the projection 21A is the most projecting part of the projection 21A from the upper wall 16*a*, and a connecting part between the extending piece 23 and the abutting piece 24. A top 32A of the embossing part 31A is the most embossing part of the embossing part 31A from the bottom wall 14 (inner wall 11*c*), and a bending part of the embossing part 31A.

The top 22A of the projection 21A and the top 32A of the embossing part 31A face each other in a direction perpendicular to the terminal pin insertion direction A. A gap S1 (FIG. 1) between the tops 22A, 32A is formed a little larger than a thickness T (FIG. 1) of the tab 51. Here, "a little larger" means that the gap S1 allows the tab 51 to be inserted thereinto. Thus, by forming the gap S1 a little larger than the thickness of the tab 51, the jig 6 thicker than the tab 51 is prevented from being inserted into the tube member 11.

The wire connecting part 40 is extended to the electric contact part 10. As shown in FIG. 1, the wire connecting part 40 includes: a base plate 41 extended to the electric contact part 10; and a plurality of crimping pieces 42 extended to the bottom plate 41. The bottom plate 41 is formed in an oblong plate shape. An end of an electric wire at which core wire is exposed is disposed on the bottom plate 41.

The crimping pieces 42 are disposed at both ends of the bottom plate 41 in a width direction of the bottom plate 41. Each crimping piece 42 is bent toward the bottom plate 41, and crimped to catch the electric wire between the crimping piece 42 and the bottom plate 41. By catching the electric wire with the crimping piece 42, the electric wire is attached to the wire connecting part 40, and the female type terminal pin 1A is electrically connected to the electric wire.

When the female type terminal pin 1A and the male type terminal pin 5 are connected to each other, firstly, electric wires are respectively connected to the wire connecting parts 40, 53 of the male and female type terminal pins 5, 1A. Next, the tab 51 is passed through the gap S1 between the top 22A of the projection 21A and the top 32A of the embossing part 31A, and inserted into the tube member 11 via the opening at the one end 11*a* of the tube member 11.

Then, as shown in FIG. 2, the tab 51 elastically deforms the elastic piece 13, and is caught between the tip of the elastic piece 13 and the contact part 12 due to restoring force of the elastic piece 13 to be held in the tube member 11. Thus, the female type terminal pin 1A and the male type terminal pin 5 are electrically connected to each other.

As shown in FIG. 3, when the jig 6 thicker than the tab 51 is tried to be inserted into the tube member 11 of the female type terminal pin 1A, because the gap S1 between the top 22A of the projection 21A and the top 32A of the embossing part 31A is formed a little larger than the thickness T of the tab 51, the jig 6 cannot be passed through the gap S1, thereby the jig 6 is prevented from being inserted into the tube member 11.

Further, when the jig 6 which cannot be passed through the gap S1 is forcibly tried to push into the tube member 11, the extending piece 23 of the projection 21A receives large force to be tried to be deformed in a direction R1 approaching the upper wall 16*a*. However, the tip of the abutting piece 24 abuts on the upper wall 16*a* in the direction of an arrow R1 to prevent the extending piece 23 from approaching the upper wall 16*a*, and prevent the extending piece 23 from being deformed. Further, because the shape of the embossing part 31A is in the inverted V shape, the embossing part 31A is hard to be deformed. Namely, the gap S1 does not become larger than the thickness T of the tab 51, the jig 6 cannot be passed through the gap S1, and the jig 6 is prevented from being inserted into the tube member 11.

According to this embodiment, the projection 21A partially covering the opening at the one end 11*a* of the tube member 11 includes: the extending piece 23 extended to the upper wall 16*a* of the tube member 11 and extended to the rear part of the tube member 11; and the abutting piece 24 extended from the extending piece 23 toward the upper wall 16*a*. Therefore, even when the jig 6 thicker than a specific thickness is tried to be inserted into the tube member 11, the tip of the abutting piece 24 abuts on the upper wall 16*a* to prevent the extending piece 23 from approaching the upper wall 16*a*, and prevent the extending piece 23 from being deformed.

Accordingly, the jig 6 or the like is surely prevented from being inserted into the tube member 11. Therefore, the elastic piece 13 is surely prevented from being excessively elastically deformed to be permanently deformed or damaged. A contact surface of the contact part 12 or the elastic piece 13 with the tab 51 is surely prevented from being damaged to increase contact resistance of the contact surface. Thus, reliability of electric contact between the male and female terminal pins 5, 1A is improved.

The female type terminal pin 1A further includes: the embossing part 31A embossing from the inner wall 11*c* of the tube member 11 toward the projection 21A, and the gap S1 between the top 22A of the projection 21A and the top 32A of the embossing part 31A is formed a little larger than the thickness T of the tab 51 of the male type terminal pin 5. Therefore, the jig 6 is surely prevented from being inserted into the tube member 11.

In the first embodiment described above, the electric contact part 10 includes: the embossing part 31A as a second projection. However, it is not necessary that the electric contact part 10 should include the embossing part 31A. In this case, a projection length of the projection 21A is longer to make a gap between the projection 21A and the inner wall 11*c* of the tube member 11 a little larger than the thickness T of the tab 51. Further, in this case, preferably, the contact part 12 is also flat. Thus, the tab 51 inserted into the tube member 11 is arranged parallel to the tube member 11.

Second Embodiment

Next, a female type terminal pin 1B according to a second embodiment of the present invention will be explained with reference to FIGS. 4 to 7. Incidentally, the same element as that described in the first embodiment is given the same reference symbol to omit the detailed description thereof.

Comparing to the female type terminal pin 1A of the first embodiment, the female type terminal pin 1B of the second embodiment includes a projection 21B and a folded part 31B instead of the projection 21A and the embossing part 31A, and further includes a locking hole 18.

Figure 5:
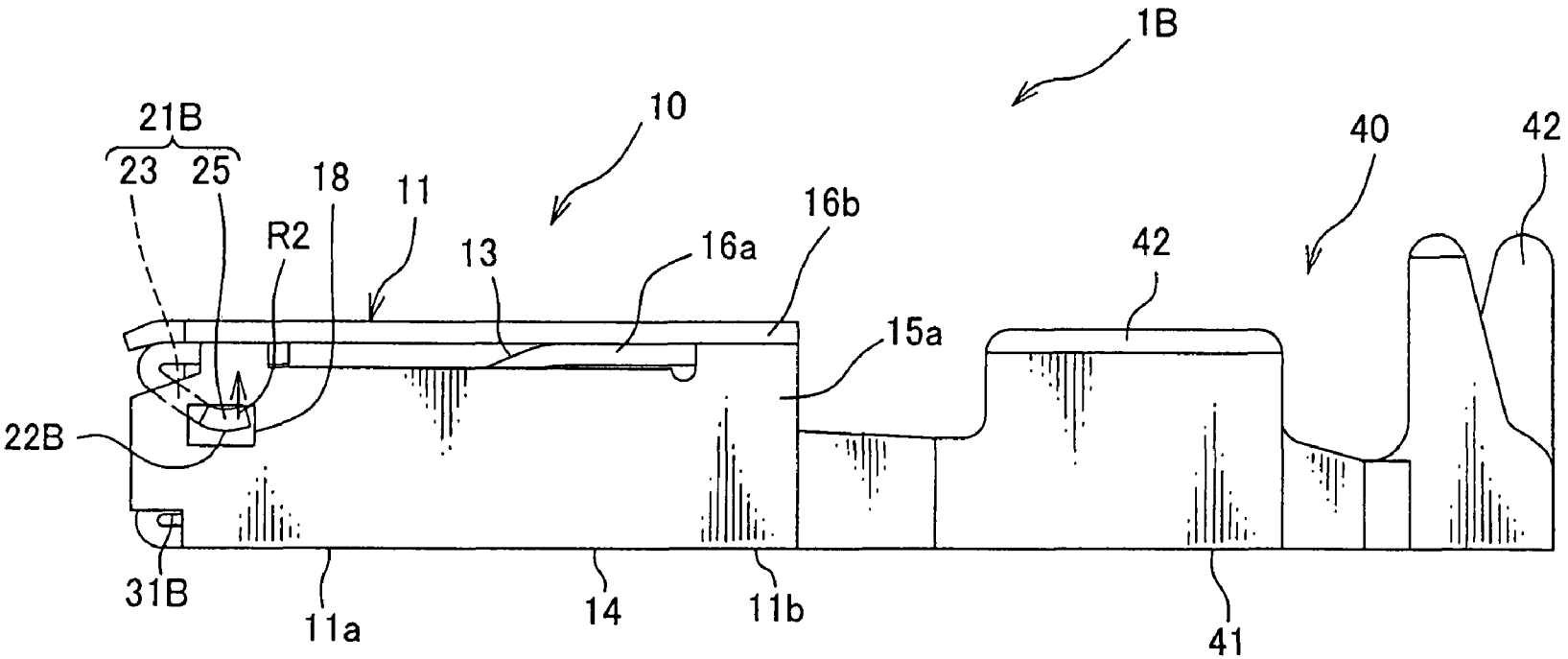
FIG. 5 is a side view showing the female type terminal pin shown in FIG. 4.
Figure 6:
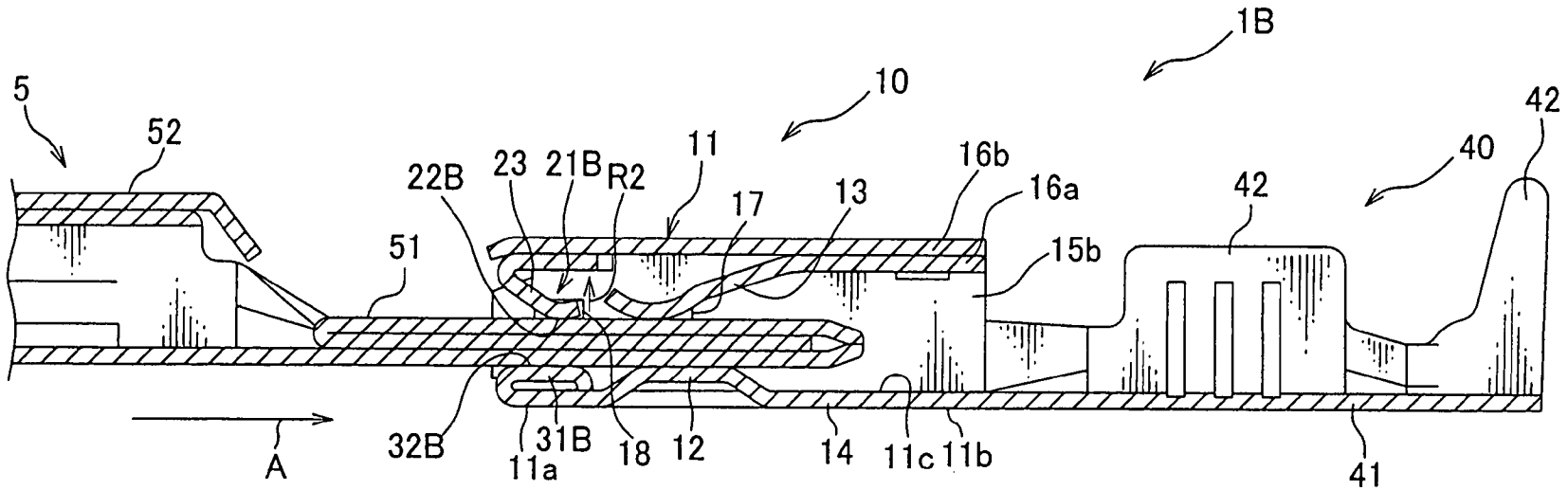
FIG. 6 is a sectional view showing a state that the male type terminal pin is connected to the female type terminal pin shown in FIG. 4.

As shown in FIG. 5, the projection 21B includes: an extending piece 23 and a locking piece 25. The locking piece 25 is disposed near a tip of the extending piece 23. A pair of locking pieces 25 is projected from both ends of the extending piece 23 in a width direction of the extending piece 23.

Figure 4:
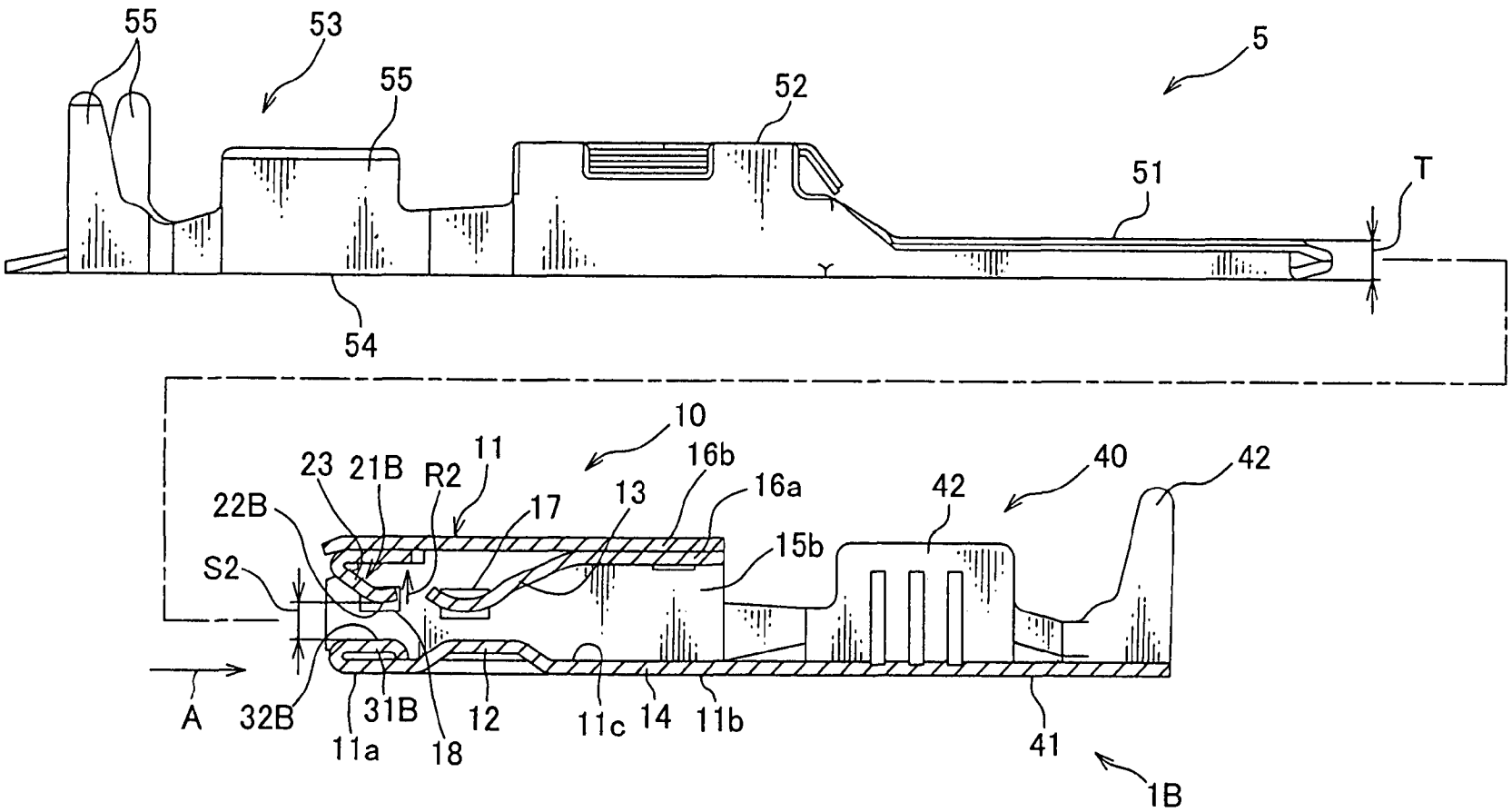
FIG. 4 is a partially sectional view showing male and female terminal pins according to a second embodiment of the present invention.

The folded part 31B as a second projection is made by forming a long bottom wall 14 of the tube member 11, and folding the long bottom wall 14 toward an inside of the tube member 11. As shown in FIG. 4, the folded part 31B is arranged parallel to the bottom wall 14, and faces the bottom wall with a little gap, and a tip of the folded part 31B is bent toward the bottom wall 14. The folded part 31B is projected from the inner wall 11*c* of the tube member 11 facing the projection 21B in a length at least the thickness of the folded part 31B. An outer surface of the folded part 31B near the inside of the tube member 11 is formed flat.

A top 22B of the projection 21B is the most projecting part of the projection 21B from the upper wall 16*a*, and the tip of the extending piece 23. A top 32B of the folded part 31B is the most projecting part of the folded part 31B from the bottom wall 14 (inner wall 11*c*), and an outer surface of the folded part 31B.

The top 22B of the projection 21B and the top 32B of the folded part 31B face each other in a direction perpendicular to the terminal pin insertion direction A. Further, a gap S2 between the tops 22B, 32B is formed a little larger than the thickness T of the tab 51. Namely, the gas S2 allows the tab 51 to be inserted thereinto. Thus, by forming the gap S2 a little larger than the thickness of the tab 51, the jig 6 thicker than the tab 51 is prevented from being inserted into the tube member 11.

As shown in FIGS. 4 and 5, the locking hole 18 is formed near the one end 11*a* of the tube member 11. A pair of locking holes 18 respectively penetrates a pair of side walls 15*a*, 15*b*. A locking piece 25 is passed through the locking hole 18.

Figure 7:
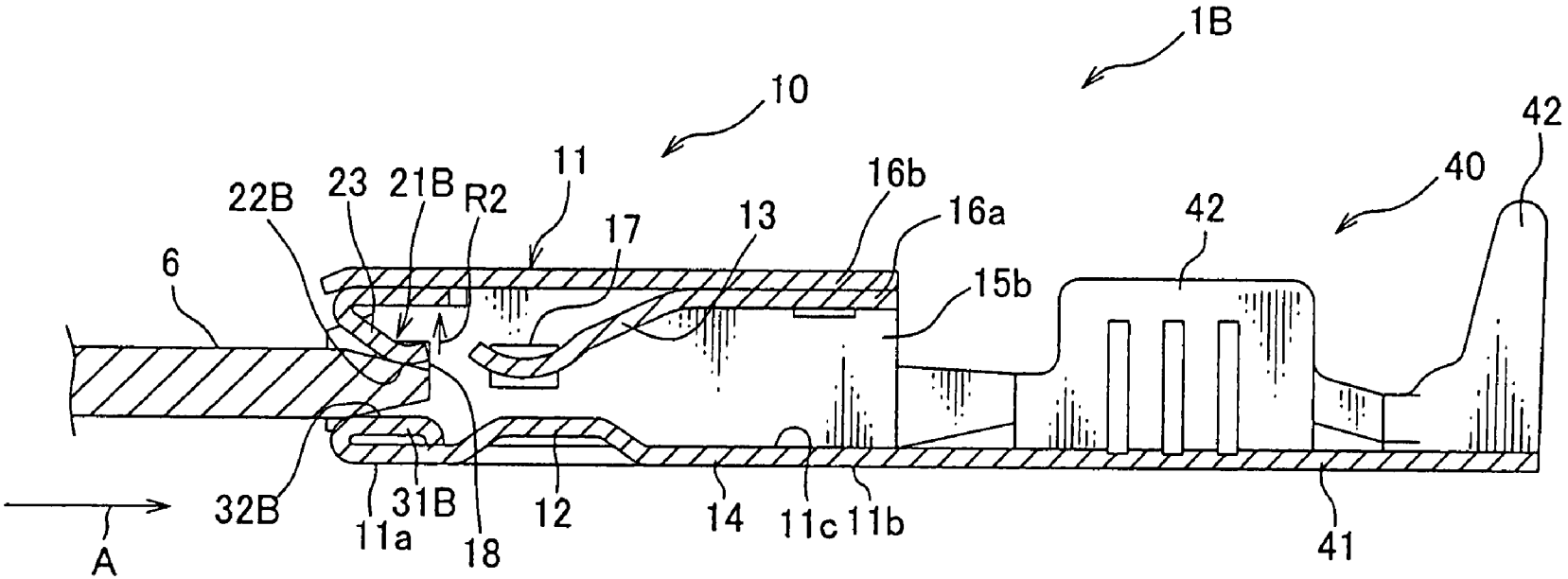
FIG. 7 is a sectional view showing a state that the jig is pushed into the female type terminal pin shown in FIG. 4.

In the female type terminal pin 1B having the above-described configuration, when the jig 6 thicker than the tab 51 is tried to be inserted into the tube member 11, because the gap S2 between the top 22B of the projection 21B and the top 32B of the folded part 31B is formed a little larger than the thickness T of the tab 51, the jig 6 cannot be passed through the gap S2 as shown in FIG. 7, and the jig 6 is prevented from being inserted into the tube member 11.

When the jig 6 is tried to be forcibly pushed into the tube member 11, the extending piece 23 of the projection 21B receives large force and is tried to be deformed in a direction R2 approaching the upper wall 16*a*. However, the locking piece 25 in the locking hole 18 abuts on an inner wall of the locking hole 18 in an arrow R2 direction to prevent the extending piece 23 from approaching the upper wall 16*a*, and to prevent the extending piece 23 from being deformed. Further, because the folded part 31B is made by folding the bottom wall 14 of the tube member 11, the folded part 31B is hard to be deformed. Namely, the gap S2 does not become larger than the thickness T of the tab 51, the jig 6 cannot be passed through the gap S2, and the jig 6 is prevented from being inserted into the tube member 11.

According to this embodiment, the projection 21B partially covering the opening at the one end 11*a* of the tube member 11 includes: the extending piece 23 extended to the upper wall 16*a* of the tube member 11 and extended toward the rear side of the tube member 11; and the locking pieces 25 projected from the both ends of the extending piece 23 in the width direction of the extending piece 23. Further, the tube member 11 includes: the locking hole 18 through which the locking hole is passed. Therefore, even when the jig 6 larger than a specific size (thickness) is tried to be inserted into the tube member 11, the locking piece 25 abuts on the inner wall of the locking hole 18 to prevent the extending piece 23 from approaching the upper wall 16*a*, and to prevent the extending piece 23 from being deformed.

Accordingly, the jig 6 or the like is surely prevented from being inserted into the tube member 11. Therefore, the elastic piece 13 is surely prevented from being excessively elastically deformed to be permanently deformed or damaged. A contact surface of the contact part 12 or the elastic piece 13 with the tab 51 is surely prevented from being damaged to increase contact resistance of the contact surface. Thus, reliability of electric contact between the male and female terminal pins 5, 1B is improved.

The female type terminal pin 1B further includes: the folded part 31B projecting from the inner wall 11*c* of the tube member 11 toward the projection 21B, and the gap S2 between the top 22B of the projection 21B and the top 32B of the folded part 31B is formed a little larger than the thickness T of the tab 51 of the male type terminal pin 5. Therefore, the jig 6 is surely prevented from being inserted into the tube member 11.

In the second embodiment described above, the electric contact part 10 includes: the folded part 31B as a second projection. However, it is not necessary that the electric contact part 10 should include the folded part 31B. Further, the folded part 31B in the second embodiment can be replaced with the embossing part 31A in the first embodiment. Of course, the embossing part 31A in the first embodiment can be replaced with the folded part 31B in the second embodiment.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A female type terminal pin comprising:

an electric contact part for connecting to a male type terminal pin, wherein the electric contact part includes: a tube member defining a fixed position contact part and into which an electric contact part of the male type terminal pin is inserted from an opening at one end side of the tube member; and a projection extended to the tube member and projected toward an inside of the tube member so as to partially cover the opening at the one end side, the projection being positioned nearer to the opening at the one end side of the tube member than the fixed position contact part, and wherein the projection includes: an extending piece extended to an outer wall of the tube member, and extended toward the inside of the tube member; and an abutting piece extended from the extending piece toward the outer wall, and preventing the extending piece from approaching the outer wall.

2. A female type terminal pin comprising:

an electric contact part for connecting to a male type terminal pin, wherein the electric contact part includes: a tube member defining a fixed position contact part and into which an electric contact part of the male type terminal pin is inserted from an opening at one end side; and a projection extended to the tube member and projected toward an inside of the tube member so as to partially cover the opening at the one end side, wherein the projection includes: an extending piece extended to one outer wall of the tube member, and extended toward the inside of the tube member; and locking pieces projected from both ends of the extending piece in a width direction thereof, and wherein the tube member includes: locking holes through which the locking pieces are passed, and locking the locking pieces in a direction that the extending piece approaches the one outer wall.

3. The female type terminal pin as claimed in claim 1, wherein the electric contact part further includes: another projection projected toward the projection from an inner wall of the tube member facing the projection, and wherein a gap between a top of the projection and a top of the another projection is a little larger than a thickness of the electric contact part of the male type terminal pin.

4. The female type terminal pin as claimed in claim 2, wherein the electric contact part further includes: another projection projected toward the projection from an inner wall of the tube member facing the projection, and wherein a gap between a top of the projection and a top of the another projection is a little larger than a thickness of the electric contact part of the male type terminal pin.

* * * * *